United States Patent [19]

Schwarz

[11] 4,188,043

[45] Feb. 12, 1980

[54] SKI BRAKE APPARATUS

[75] Inventor: Günter Schwarz, Au, Zürich, Switzerland

[73] Assignee: S.A. Etablissement Francois Salomon & Fils, Annecy, France

[21] Appl. No.: 790,178

[22] Filed: Apr. 25, 1977

Related U.S. Application Data

[62] Division of Ser. No. 595,791, Jul. 11, 1975, Pat. No. 4,036,509.

[30] Foreign Application Priority Data

Jul. 17, 1974 [CH] Switzerland ..... 9863/74
Jan. 14, 1975 [CH] Switzerland ..... 478/75

[51] Int. Cl.[2] ..... A63C 7/10
[52] U.S. Cl. ..... 280/605
[58] Field of Search ..... 280/605, 604

[56] References Cited

U.S. PATENT DOCUMENTS

| | | | |
|---|---|---|---|
| 3,884,487 | 5/1975 | Wehrli | 280/605 |
| 3,940,158 | 2/1976 | Wehrli | 280/605 |
| 3,989,271 | 11/1976 | Riedel | 280/605 |

*Primary Examiner*—David M. Mitchell
*Attorney, Agent, or Firm*—Werner W. Kleeman

[57] ABSTRACT

A ski brake apparatus is provided which comprises two brake arms each mounted on one side of the ski and arranged to swing under the action of a spring force into a braking position in which each brake arm partly extends under the bottom side of the ski. Each brake arm and the associated spring is integrally formed from the same spring material. Each brake arm comprises a prolongation perpendicularly bent-off and mounted onto the ski to form the swing axis. This axis is oriented parallel with the upper side and transverse to the longitudinal direction of the ski. The end of the prolongation opposite to the brake arm is bent to form a spring bracket. The end of this spring bracket is bent parallel to the swing axis and separated from this axis in longitudinal direction of the ski. The spring bracket acts as the operation means of the brake apparatus to hold and to release the brake arm in the preparatory or stand-by position and in the braking position, respectively, and is oriented upwardly from the upper side of the ski when the brake arm is in its braking position.

7 Claims, 12 Drawing Figures

Fig. 4
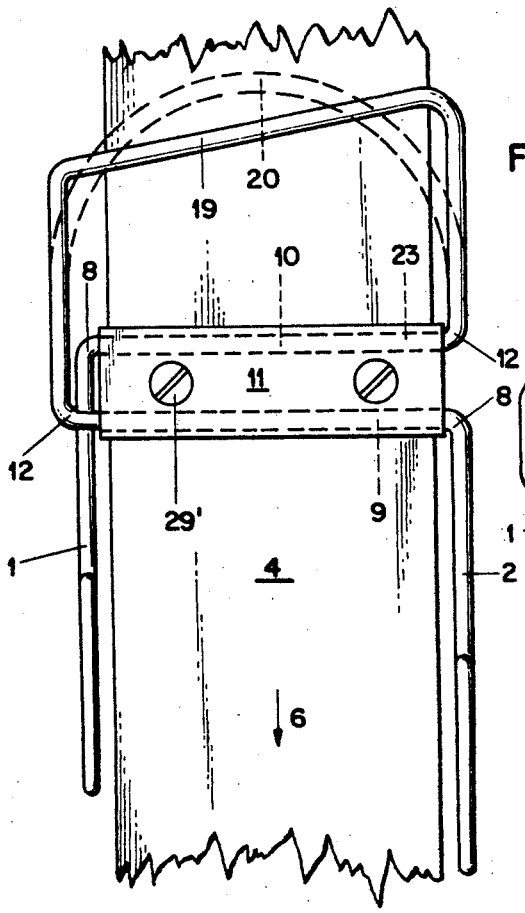
Fig. 5
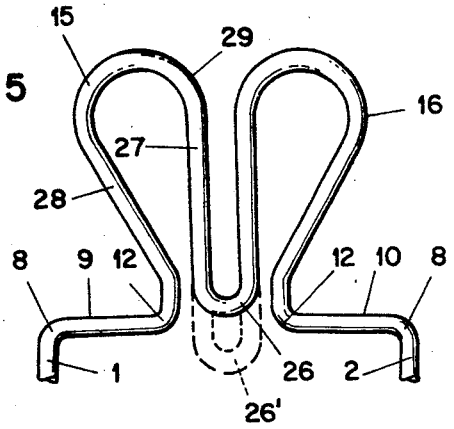
Fig. 6
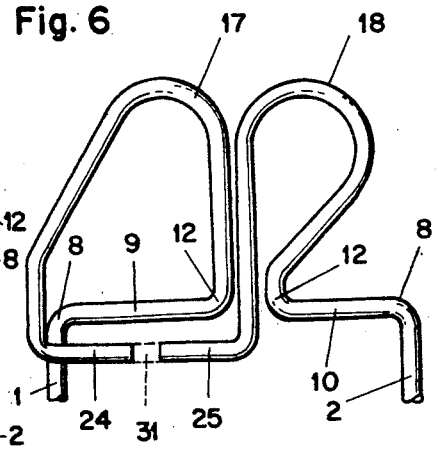
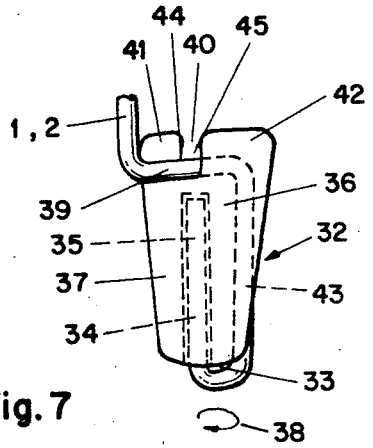
Fig. 7

SKI BRAKE APPARATUS

CROSS-REFERENCE TO RELATED CASE

This is a divisional application of my copending United States application, Ser. No. 595,791 now U.S. Pat. No. 4,036,509, filed July 11, 1975, and entitled "Ski Brake Apparatus".

BACKGROUND OF THE INVENTION

The present invention concerns a ski brake apparatus comprising two brake arms, each of which is mounted on one side of the ski and arranged to swing under the action of a spring force into a braking position in which the brake arm partly extends under the bottom side of the ski, whereby each brake arm and the associated spring is integrally formed from the same spring material.

SUMMARY OF THE INVENTION

It is a major object of the present invention to provide a ski brake apparatus of the aforementioned type which may be produced in a simple manner and with only a few elements, which apparatus allows a really reliable braking of the ski if detached from the ski boot.

The above recited and other objects are achieved with the present invention by providing a ski brake apparatus characterized in that each brake arm comprises a prolongation which is perpendicularly bent-off and mounted onto the ski to form the swing or pivot axis which is oriented parallel with the upper side and transverse to the longitudinal direction of the ski The end of this prolongation opposite to the brake arm is bent to form a spring bracket, the end of which is bent in a direction parallel to the swing axis and separated from this axis in the longitudinal direction of the ski, whereby the spring bracket acts as the operation means of the brake apparatus to hold and to release the brake arms in the stand-by or preparatory position and in the braking position, respectively, and being inclined upwardly from the upper side of the ski when the brake arm is in its braking position.

In a first preferred embodiment of the ski brake apparatus according to the invention each brake arm is provided with a separate spring bracket. In another preferred embodiment a common spring bracket is provided for the two brake arms which is possible by using the bent end part of the brake bracket as the swing or pivot axis of the other brake arm. To accomplish that the spring bracket which is upwardly directed when the brake arm is in the brake or braking position is sufficiently inclined compared with the upper surface of the ski and that it may easily be pressed onto the upper surface of the ski when the ski boot is inserted, still another preferred embodiment of the present invention contemplates that the bent end part of the spring bracket is displaced in a direction towards the tip of the ski compared with the swing axis. In yet another embodiment of the present invention a brake wing or vane is mounted at the outermost end of each brake arm, which brake wing may be turned by an angle of 90° into a brake or braking position.

Yet still another embodiment of the present invention is provided by a projection situated at the inner side of the brake arm, which projection contacts the ski when the brake arm is turned and separates the brake arm from the ski. The projection may be formed by a deflection of the spring arm constituting the brake arm, the deflection being adjacent to the lateral face of the ski.

The projection allows the desirable close arrangement of the brake wing mounted at the end of the brake arm on the ski without interfering with the upper surface of the ski when the brake wing is turned downwardly into the brake position. Such interfering is possible e.g. when the brake arm is slightly bent. Furthermore, this projection can act as a stop or obstacle in one brake direction, thus preventing a too pronounced deflection of the elastic brake arm. This advantage is very important in case the brake apparatus is to be mounted in the vicinity of the heel holder or the automatic heel holder, respectively, of the ski, because, in such case, the brake arms are rearwardly inclined in the brake position. Furthermore, it is possible to use this projection to clamp the two skis together with their sliding surfaces confronting. For this purpose, the biased brake arms of one ski can clamp the other ski as well as their brake arms, so that the adjoining brake arms are overcrossed. Loosening of this clamping which is very useful for transporting the skis is complicated by the projection gripping over the brake arm of the other ski.

This mutual clamping of the skis may be improved by a special construction of the mounting plate of the brake apparatus, which improvement is particularly useful against the longitudinal displacement of the skis. This special construction consists in extensions which project laterally over the upper surface of the ski and between which a brake arm may be locked. Such extensions are preferably arranged on a plate-like, lengthened area of the mounting plate, which area may be disposed under the head of the binding when the brake apparatus is fastened so that the extensions project on the left and on the right side of the head of the binding.

There are ski bindings for which an arrangement of the ski brake apparatus at the head of the binding is not advantageous. To fasten the same ski brake apparatus next to the heel holder of the binding without any additional constructions, it is possible to provide a breaking point between the plate-like, lengthened area of the mounting plate on which the extensions are arranged and the other area of the mounting plate. This breaking point may be any notch running across the mounting plate.

BRIEF DESCRIPTION OF THE DRAWINGS

While the specification concludes with claims particularly pointing out and distinctly claiming the subject matter regarded as forming the present invention, it is believed the invention will be better understood from the following description taken in connection with the accompanying drawings in which:

FIG. 4 is a top view of an embodiment of the brake apparatus provided with a common spring bracket for the two brake arms;

FIGS. 5 and 6 are respective top plan views showing alternative embodients of the ski brake apparatus;

FIG. 7 is a side view of the brake wing attached to the end of the brake arm;

DETAILED DESCRIPTION OF THE PREFERRED EMBODIMENTS

Figure 1:
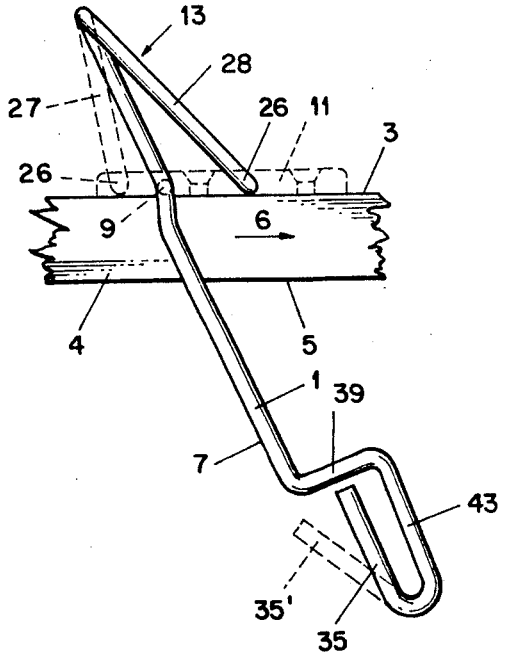
FIG. 1 is a side view of the ski brake apparatus with the brake arm in its brake or braking position.

Each of the embodiments of the present invention is provided with two brake arms 1, 2. In the brake position shown in FIG. 1 these two brake arms extend on each side of the ski 4 from the upper surface 3 beyond the bottom surface 5. In this position, the brake arms are inclined forwardly, i.e. in the direction of the fore-end or front of the ski. This direction is indicated in FIGS. 1 to 4 by the arrow 6. During braking and under the action of the forward movement of the ski the brakes are breaking or ground into the snow. The inclination facilitates this breaking and prevents bending of the brake arms beyond the vertical. If only one brake arm would be used, the ski would be rotated around this brake arm so that only the inclined backside 7 would produce a braking force. This braking force would bend the brake arm into a more even or flatter configuration. In each of the shown embodiments of the brake apparatus one end of the brake arm 1 or 2, respectively, is provided with a rectangular bend 8 leading to a prolongation 9, 10 which forms the swing or pivot axis of the brake arm. As can be seen from the drawings the prolongations or portions 9, 10 extend parallel to the upper surface and transverse to the longitudinal direction of the ski. The prolongations may rest on the upper surface 3 or may be completely encased in a mounting plate 11. The prolongations 9, 10 are swingable around their longitudinal axis but preferably are fastened relative to the ski.

The end of the prolongation 9, 10 opposite to the corresponding brake arms is provided with another bend 12 to form a spring bracket 13–20. As shown in FIG. 1, this spring bracket extends from the upper surface of the ski upwardly when the corresponding brake arm is in the ski brake position. The end part 21–26, 26' of the spring bracket 13–20 is bent in a direction parallel to the prolongation 9 and is displaced in the longitudinal direction of the ski compared with this prolongation. This results in the fact that, seen in the longitudinal direction of the ski, the end part of the spring bracket is disposed forwardly or rearwardly of the prolongation forming the swing or pivot axis and is, therefore, provided with a pitch. This bent end part of the spring bracket may be encased in the same mounting plate like the prolongation so that no movement relative to the ski will be possible.

Figure 2:
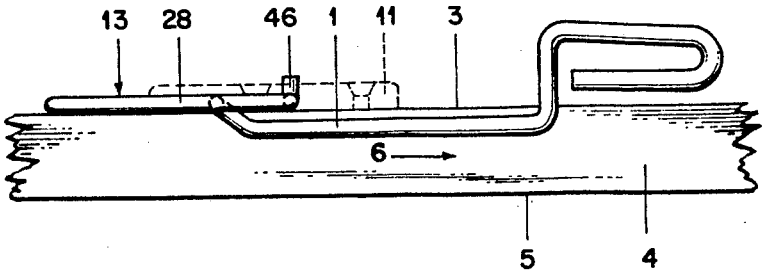
FIG. 2 is a side view of the ski brake apparatus shown in FIG. 1 with the spring bracket pressed onto the upper surface of the ski and the brake arm in stand-by or preparatory position.

If the bent end part of the spring bracket is disposed forwardly of the prolongation forming the swing axis the inclination of the spring bracket relative to the upper surface of the ski will be smaller than with the bent end part disposed behind the prolongation, and the spring bracket will be pressed against the upper surface of the ski more easily when the ski boot is inserted into the binding. This is shown in FIG. 1 where the disposition of the bent end of the bracket behind the prolongation forming the swing axis and the corresponding disposition of the leg 27 are indicated with broken lines. The disposition of the bent end 26, 26' of the bracket behind the prolongation 9 or swing axis allows the realization of an embodiment with a bent end of the bracket based on the upper surface 3 or on a plate (not shown) only. This disposition permits the bent end to slip forwardly on the upper surface of the ski or the said plate when the bracket 16 is pressed downwardly. The spring force of the bracket 16 is created by the torsion of the junction between the two bracket legs 27, 28 as in the turning of a helical spring. This spring force tends to return the bracket leg 27 in the position shown in broken lines in FIG. 1 after the spring bracket has been pressed down onto the upper surface of the ski as shown in FIG. 2. In this position the bracket is again erected and the brake arm is turned upwardly while the bent end 26 of the leg 27 or the bracket rests upon the upper surface of the ski. With such embodiments of the ski brake apparatus having the bent end of the bracket before the swing axis the distribution of the forces is reversed, i.e. the spring force created when the bracket is pressed downwardly in the position as shown in FIG. 2 causes the prolongation 9 to press against the upper surface of the ski while at the same time a tension acts onto the bracket leg 28 running to the bent end of the bracket. With this embodiment it is, therefore, necessary to prevent the lifting of the bent ends 21, 22 from the upper surface of the ski. This may be achieved by providing a mounting plate 11 having grooves or notches in its bottom surface in which the bent end of the bracket as well as the prolongation forming the swing axis may be lodged. This mounting plate can be fastened on the upper surface of the ski by means of bolts 29. For each embodiment of the present invention either the prolongation forming the swing axis or the bent end of the spring bracket has to be indisplaceably fastened onto the ski. It is, however, possible to fasten both the prolongation and the bent end on the ski, e.g. by means of the described mounting plate 11.

Figure 3:
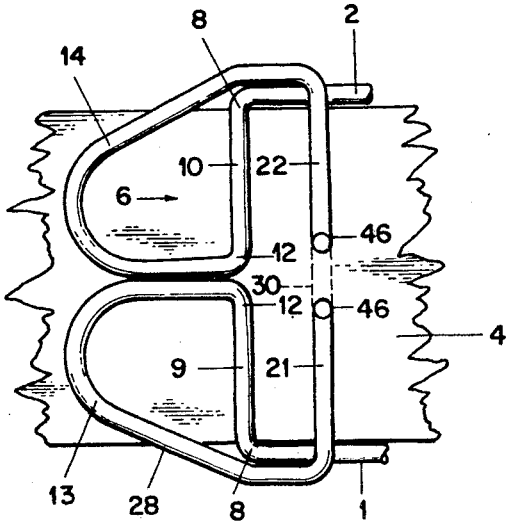
FIG. 3 is a top plan view of the brake apparatus in the position as shown in FIG. 2.

The two spring brackets 13, 14, 15, 16 or 17, 18 may be realized in different forms and attached in different manners as shown for the embodiments according to FIGS. 3, 5 and 6. The advantage of the embodiment shown in FIG. 3 compared with the embodiment as shown in broken lines in FIG. 5 is that the longer prolongations 9, 10 forming the swing axis of the brake arms and the longer bent ends 21, 22 of the brackets can more effectively be fastened in a mounting plate 11 or another corresponding element against the spring force or brake force.

The two spring brackets of the brake apparatus shown in FIGS. 3, 5 and 6 may be connected along their bent ends to form one integral element as indicated by the broken lines 30 and 31 in FIGS. 3 and 6, respectively. The realization with separated bent ends has the advantage that the two brake arms 1, 2 may be turned independently which allows a higher degree of reliability of the brake apparatus.

In the embodiment with separated spring brackets the opposite bent ends 21, 22 may form an upwardly directed hook, the hook-like part 46 of which may extend upwardly through an opening in the middle of the mounting plate to tie the ends 21, 22 of the spring brackets additionally in the direction across the ski. This construction has the advantage that the spring force of the bracket, which force acts in the plane of the bracket and across the longitudinal direction of the ski, creates a pretension which in turn draws the brake arm to the outer side of the ski or its laterally projecting sliding edge. This construction permits also to adjust the distance between the two brake arms to different widths of different skis.

FIG. 4 shows an embodiment of the brake apparatus, the two brake arms 1, 2 of which are connected with a common spring bracket 19 and 20, respectively. This is achieved by using the bent end of the spring bracket of one brake arm as the prolongation or swing axis of the other brake arm. In other words, and according to the definition as used hereinbefore, the prolongations 9, 10 or the swing axis of the two brake arms forms the bent end of the spring bracket also. To realize this embodiment the two brake arms are displaced in the longitudinal direction of the ski by a distance corresponding to the distance between the two swing axes. Furthermore, this embodiment does not allow the independent function of the two brake arms which means that the brake apparatus is ineffective if only one of the arms is bent or locked.

Compared with the embodiments having one spring bracket only the embodiments with two spring brackets have the advantage that the two brackets form a symmetric two-point-seat when the ski boot is placed upon the ski and presses the brackets down which in turn prevents the lateral sliding-out of the ski boot from the binding or down from the ski prior to the closing of the binding. The brake arms preferably are made of spring wire or another wire with great elasticity and strength. In a preferred embodiment the brake arms have a diameter of at least 2 mm and preferably 4 mm so that they can withstand a great brake force without being bent rearwardly.

To enable an easy pressing of the spring brackets in the position shown in FIG. 2 even when the diameter of the wire from which the brake arms and brackets are bent is relatively large the brake apparatus may be fastened near the front part of the binding. This provides a leverage favorable for the pressing of the brackets when the tip of the ski boot is introduced into the front part of the binding.

To increase the resistance created when the brake arms are forced into the snow the ends of the brake arms are broadened by blade- or winglike elements. To avoid the possibility that during skiing such a broadening element projects laterally sufficiently to ram an obstacle, in another preferred embodiment, the brake blade 32 is rotatably mounted at the end of the brake arm and may be swung at about 90° into a brake position which is transverse to the longitudinal direction of the ski.

One example of such a brake blade 32 as well as its attachment and bearing at the end of the brake leg 1, 2 is shown in FIG. 7. A bore or hole 34 is provided in the outer or lower front end 33 of the brake blade. This bore passes through the blade parallel to and is displaced with respect to the brake arm 1, 2 and is used to insert the hook-like bent outermost or free end 35 of the brake arm. To simplify the construction of this bore the blade preferably is thickened along its center line. Thus, the end 35 of the brake arm is used as the swing or pivot axis of the brake blade 32. To attain that the brake blade is turned into a position transverse to the direction of motion when dipping the blade into the snow the cylindrical bore 34 which forms a guide bearing for the end 35 of the brake arm is eccentrically arranged so that a greater and a smaller brake area 36 and 37, respectively, are formed. These brake areas are arranged on the two sides of the swing or pivot axis of the brake blade and the end of the brake arm, respectively. The greater braking force acting upon the greater brake area 36 causes the brake blade to be turned in the direction of the arrow 38. To limit the rotation to an angle of about 90° an opening 40 is provided in the upper front part of the brake blade and a part 39 of the brake arm extends through this opening in a direction transverse to the swing axis of the brake blade. The opeing 40 is located between two zones 41, 42 of the brake blade which are displaced with respect to the center line by a distance corresponding to about the thickness of the brake arm.

This displacement of the two blade areas 41, 42 enables the position of the brake blade as shown in FIG. 7 in which position the plane of the blade is parallel to the longitudinal direction of the ski and the swinging plane of the brake arm 1, 2, respectively. In this position, the front surface of the blade area 41 shown in FIG. 7 and the back surface of blade area 42 are adjacent to part 39 of the brake arm bent in a right angle. Furthermore, the back surface of the greater brake area 36 is, according to FIG. 7, adjacent to the part 43 of the brake arm which joins the part 39 oriented transverse to the brake arm with the upwardly bent free end 35 of the brake arm. After the brake blades have been turned by 90° in the direction of the arrow 38 the inner edge 44 of the blade area 41 and one edge of the opening 40, respectively, is supported on the transversely oriented part 39 of the brake arm so that the brake blade is secured in its brake position transverse to the direction of movement of the ski.

When treading upon the spring bracket and swinging the brake arms upwardly, the back surface of the smaller brake area 37 (FIG. 7) which is adjacent to the ski bears against the lower edge of the ski so that the brake blade will be turned into the position shown in FIG. 7 in which position the blade is parallel to the lateral surface of the ski.

The described brake blade 32 may also be used to secure the brake arms 1, 2 against the spring force of the brackets in the upward position shown in FIG. 2 in case the ski is not used or during transport. This is considered to be another advantage of the brake blade. For this, it is sufficient to bend the brake arms slightly in lateral and upward direction and to place the outer side (the front side according to FIG. 7) to the smaller brake area 37 upon the laterial region of the upper surface 3 of the ski. The inner edge 45 of the brake area 42 is adjacent to the transversely oriented part 39 of the brake arm and prevents the brake blade from pitching downwardly.

To assemble the brake blade 32 with the brake arm the blade simply is slipped onto the utmost or outer end 35' of the brake arm which end is preferably slightly bent outwardly as shown by the broken lines in FIG. 1. When the end 35' of the brake arm is bent inwardly into the position as shown in full lines, the brake blade is undetachably locked on the brake arm without restraining the intended 90° swinging movement.

Figure 8:
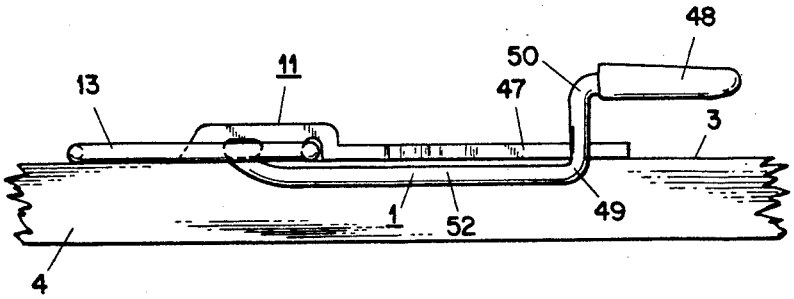
FIG. 8 is a side view of a ski brake apparatus with the brake arms in the skiing position.

The embodiment shown in FIG. 8 comprises a mounting plate 11 with a plate-like prolongation 47. Furthermore the brake blades 48 are immovably fixed on the brake arms and, consequently, parallel to the upper surface of the ski when they are in the skiing position. In spite of this arrangement, the brake blade is not hindering to the skier even when skiing traversely along a slope because it is displaced upwardly and parallel to the brake arm 1 by two bends 49, 50. So, the brake blades are arranged on the right and on the left hand side of the not shown head of the binding. The plate-like prolongation 47 is provided with a number of elongated openings 51 intended to pass the clamping bolts for the head of the binding.

Figure 9:
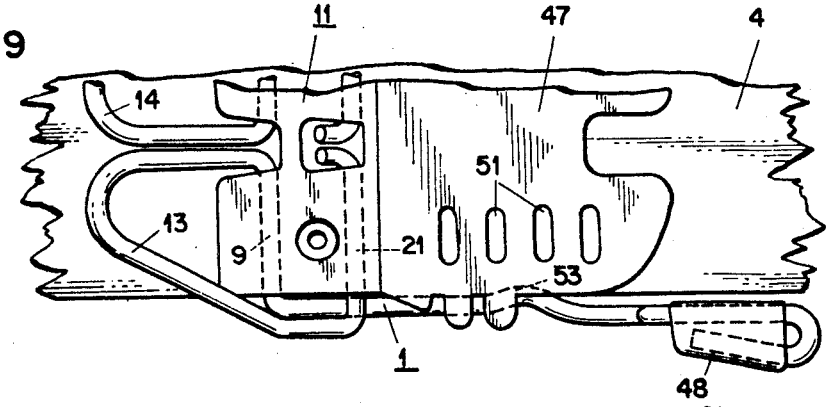
FIG. 9 is a top plan view of the right side of the brake apparatus seen in the longitudinal direction of the ski.

The center part 52 of each brake arm 1 is provided with a deflection 53 directed towards the ski 4. In the embodiment shown in FIG. 9 this deflection is curved arc-like. This deflection is intended to ensure that the brake arm 1 with its brake blade 48 is moved upwardly in a path aside from the lateral surface of the ski and that the arm cannot block at the under edge of the ski when the ski boot is inserted into the binding as it may be possible with a buckled brake arm. The deflection 53 prevents blocking of the brake arm on the upper edge of the ski as well. In the embodiment shown in FIGS. 9 and 11 the prolongation 47 of the mounting plate 11 comprises lateral extensions 54–56 protruding the lateral edges of the ski. These extensions preclude any movement of the center part of the brake arm above the upper surface of the ski. The gaps 57, 58 are intended to engage with the brake arm of the other ski when two skis are joined together with adjacent running surfaces as may be desirable e.g. for transport.

Figure 10:
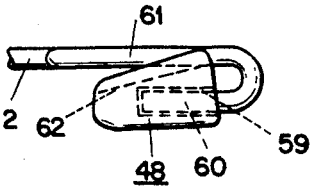
FIG. 10 is a top plan view of the end of the brake arm before attaching the brake wing.

FIG. 10 shows the attachment of the brake blade 48 on the bent end of brake arm 1. The blade is provided with a boring or bore 59 in which the end 60 of the arm which previously was bent by about 180° is introduced. Hereafter the end of the brake arm is further bent inwardly to the adjacent part of the brake arm into the position shown in FIG. 10. In this position the straight part 61 of the brake arm is pressed into a groove 62 provided in one of the lateral edges of blade 48.

Figure 11:
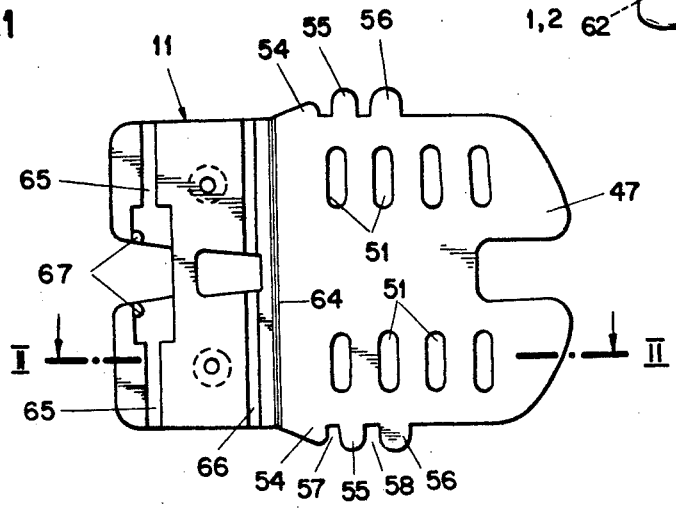
FIG. 11 is a bottom view of the mounting plate.
Figure 12:
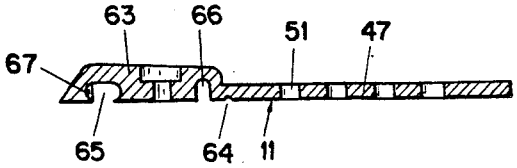
FIG. 12 is a cross-section of the bottom plate shown in FIG. 11 taken along line II—II thereof.

The construction of the mounting plate 11 can best be seen from FIGS. 11 and 12. Between the retention part 63 intended to secure the prolongations 9, 10 or ends of the spring bracket 21, 22 and the prolongation 47 a transverse notch 64 is provided. The retention part 63 and the prolongation 47 may be separated by breaking the plate 11 along the notch 64. Breaking the plate may become necessary if in the region of the heel holder of the ski binding only the retention part 63 of the mounting plate is required.

As may further be seen from FIGS. 11 and 12 the groove 65 intended to insert the prolongation 9, 10 of the brake arm is in the longitudinal direction of the plate essentially larger than the groove 66 intended to insert the end 21, 22 of the spring bracket. This construction favors the lateral movement of the prolongation 9, 10 used as the swing axis during the swing movement. At the central part of the groove 65 a cam 67 is provided. This cam is intended to be a bearing surface for the prolongation 9, 10 and to serve as a point of rotation. This results in an easy downward movement of the spring bracket 13 to move the brake apparatus in the stand-by position and an unobstructed release movement.

While particular emobodiments of the present invention have been illustrated and described, it will be obvious to those skilled in the art that various changes and modifications can be made without departing from the spirit and scope of the invention and it is intended to cover, in the appended claims, all such changes and modifications that are within the scope of this invention.

What I claim is:

1. A brake apparatus for a ski having opposite lateral sides and upper and lower surfaces, said brake being securable to the upper surface of said ski and comprising:

two pivotable brake arms, each arm being respectively located adjacent one of the opposite sides of the ski;

a common spring bracket located above the upper surface of the ski and having bent ends defining respectively a first shaft connected with a first brake arm and a second shaft connected with the second brake arm, said shafts forming pivot axis for the corresponding brake arm and being arranged substantially parallel to the upper surface of the ski, transverse to the longitudinal axis thereof and in spaced relationship to one another in the lengthwise direction of the ski; and means for pivotally mounting the brake arm shafts on the ski so as to enable pivoting of said brake arms from a preparatory position in which said brake arms lie above the lower surface of the ski into a braking position in which the brake arms extend at least partly beneath the lower surface of the ski.

2. A ski brake apparatus as claimed in claim 1 wherein each arm shaft connects the corresponding brake arm adjacent to one side of the ski with a part of the spring bracket adjacent the other side of the ski.

3. A ski brake apparatus as claimed in claim 1 wherein each of said brake arms have an outer end positioned forwardly in the direction of the ski tip with respect to the pivot axis of said brake arm.

4. In a ski brake securable to the upper surface of a ski and having, laterally of the ski, first and second brake spurs which are pivotable abut first and second pivot axes, respectively, extending on the upper side of the ski transversely with respect to the longitudinal axis thereof and a holding lever depressible by the ski boot to hold said brake spurs in a rest position, said brake spurs being pivoted into their braking positions by spring action upon removal of a ski boot from the ski binding, the improvement in the brake comprising a wire bent so that one end portion forms a first one of said brake spurs, the other end portions forms the second one of said brake spurs, a first central shaft portion lies in the first one of said pivot axes, a second central portion is shaped into a holding loop forming said holding lever, and a third central shaft portion lies in the second one of said pivot axes, said first and second axes being parallel and longitudinally space apart, said holding loop acting as a spring which moves said spurs to their braking positions and having two positions, one position being against the ski when depressed by the ski boot and the other position being away from the ski when the ski boot is removed from the binding.

5. A ski brake as claimed in claim 4, and further comprising a holding plate fastenable to the upper side of the ski, and having means defining first and second recesses in which said first central shaft portion and said third central shaft portion are located respectively.

6. A ski brake according to claim 4 and further comprising a protective cap enclosing and protecting each of said brake spurs.

7. A ski brake as claimed in claim 4, wherein said wire is of circular cross-section throughout its length.

* * * * *